US005623184A

United States Patent [19]

Rector

[11] Patent Number: 5,623,184

[45] Date of Patent: Apr. 22, 1997

[54] LAMP CIRCUIT WITH FILAMENT CURRENT FAULT MONITORING MEANS

[75] Inventor: Robert E. Rector, McKinney, Tex.

[73] Assignee: Gulton Industries, Inc., Plano, Tex.

[21] Appl. No.: 645,049

[22] Filed: May 14, 1996

Related U.S. Application Data

[63] Continuation of Ser. No. 397,785, Mar. 3, 1995, abandoned.

[51] Int. Cl.[6] ..... H05B 37/00

[52] U.S. Cl. ..... 315/102; 315/106; 315/107; 315/225

[58] Field of Search ..... 315/307, 225, 315/224, 107, 105, 109, 102, 176, 219, 209 R

[56] References Cited

U.S. PATENT DOCUMENTS

| | | | |
|---|---|---|---|
| 2,923,856 | 2/1960 | Greene et al. | 315/307 |
| 4,538,095 | 8/1985 | Nilssen | 315/225 |
| 4,603,281 | 7/1986 | Nilssen | 315/107 |
| 4,920,299 | 4/1990 | Presz et al. | 315/219 |
| 5,261,831 | 11/1993 | Vendal et al. | 439/232 |
| 5,349,272 | 9/1994 | Rector | 315/294 |
| 5,367,223 | 11/1994 | Eccher | 315/219 |

OTHER PUBLICATIONS

Silicon General; "SG1548 Quad Power Fault Monitor" Device Description and Application Notes; pp. 4:157–160 and 12:91–97. Dated before the invention thereof by applicant.

*Primary Examiner*—Robert Pascal
*Assistant Examiner*—Michael Shingleton
*Attorney, Agent, or Firm*—Darby & Darby

[57] ABSTRACT

A ballast arrangement is disclosed for use in powering fluorescent and other gas discharge lamps. The ballast arrangement controls the arc voltage provide by an arc voltage oscillator independent of the filament voltage provided by a filament voltage oscillator. In this manner, safe maintenance condition during fault and interrupt condition are obtained. The full arc voltage is only applied to the lamp when the lamp filaments are warm or after a time period during which they are warmed. The filament pre-warming time reduces sputtering when an excitation or arc voltage in subsequently applied to induce lamp arcing.

25 Claims, 5 Drawing Sheets

LAMP CIRCUIT WITH FILAMENT CURRENT FAULT MONITORING MEANS

This is a continuation of application Ser. No. 08/397,785, filed Mar. 3, 1995 now abandoned.

BACKGROUND OF THE INVENTION

This invention relates to a circuit for powering fluorescent lamps and more particularly to a ballast circuit for extending the life of one or more lamps attached thereto.

Fluorescent lamps are in wide spread use in office buildings, public areas and mass transit vehicles throughout the world. Periodically, these fluorescent lamps require servicing. For example, a filament may have broken or sputtered away, or a lamp may have become unseated from its socket. With conventional ballast arrangements, these circumstances create a potential fire or shock hazard, especially when service personnel remove or replace one lamp of several lamps connected to the same ballast arrangement. Accordingly, it would be desirable to provide a ballast arrangement in which fault conditions are accommodated by reducing or eliminating any shock and fire hazards.

While fluorescent or discharge lamps offer significantly greater efficiency of light output in terms of lumens per watt, as compared to incandescent lamps, their effective lifespans are adversely affected by sputtering of their filaments which may occur whenever a cold start is effected. It has been empirically determined that the life of a fluorescent lamp is dependent, in part, upon the number of times that the lamp is switched on and off. As a general rule, it has been observed that approximately three hours of lamp life is dissipated each time that a lamp is switched on using a conventional cold start ballast arrangement. A fluorescent lamp will last for a number of years if it is switched on and left on.

One approach to maintain the filaments warm and thereby reduce sputtering effects is in a ballast arrangement in which an impedance is selectively introduced into the lamp circuit to reduce the excitation voltage below that necessary to sustain the arc discharge and thereby to turn the lamp off while maintaining current through the filament. Such prior art circuits are merely voltage reducing circuits which selectively terminate light production from the lamps from the high-voltage output side of the ballast arrangement. Risks of shock to maintenance personnel, as well as the risk of fire, remain. There is therefore a need for a simple ballast circuit capable of reducing or eliminating such fire and shock hazards. Further, there remains a need to reduce filament sputtering when the lamp is initially turned on.

In accordance with the invention, several lamps may be electrically connected to a single ballast unit, each of which has its arc voltage turned off independent of its filament voltage when a fault or interrupt condition is detected, and has the arc voltage applied to the lamp filaments only when the lamp filaments are warm or after a time period during which they are warmed so that sputtering when an excitation for arc voltage is subsequently applied is reduced.

SUMMARY OF THE INVENTION

It is an object of the present invention to provide an improved ballast circuit to power at least one fluorescent lamp.

An additional object is to warm the filaments of a fluorescent lamp prior to applying an arc discharge excitation voltage, to reduce lamp filament sputtering.

An object is also to extend the useful life of one or more lamps attached to the ballast circuit.

Another object is to eliminate fire or shock hazard conditions whenever there is a fault or interruption in connection of a fluorescent lamp attached to the ballast circuit.

Yet another object is to conserve power for so long as a fault or interruption condition subsists.

A further object of this invention is to provide a ballast circuit with the foregoing advantages with minimal cost and complexity.

These and other objects are achieved according to the present invention by a circuit that, in one aspect, permits soft-starting at least one fluorescent lamp attached thereto, and, in another aspect, permits shutting down the arc voltage source to terminate lamp arcing independent of the state of the low or filament voltage source. In yet a further aspect of the invention, the high or arc voltage source is shut down automatically when a fault condition is detected and the arc voltage is re-applied to the lamp when the fault condition is corrected. Additional features and advantages are best appreciated with reference to the figures and detailed description.

DETAILED DESCRIPTION OF THE INVENTION

Figure 1:
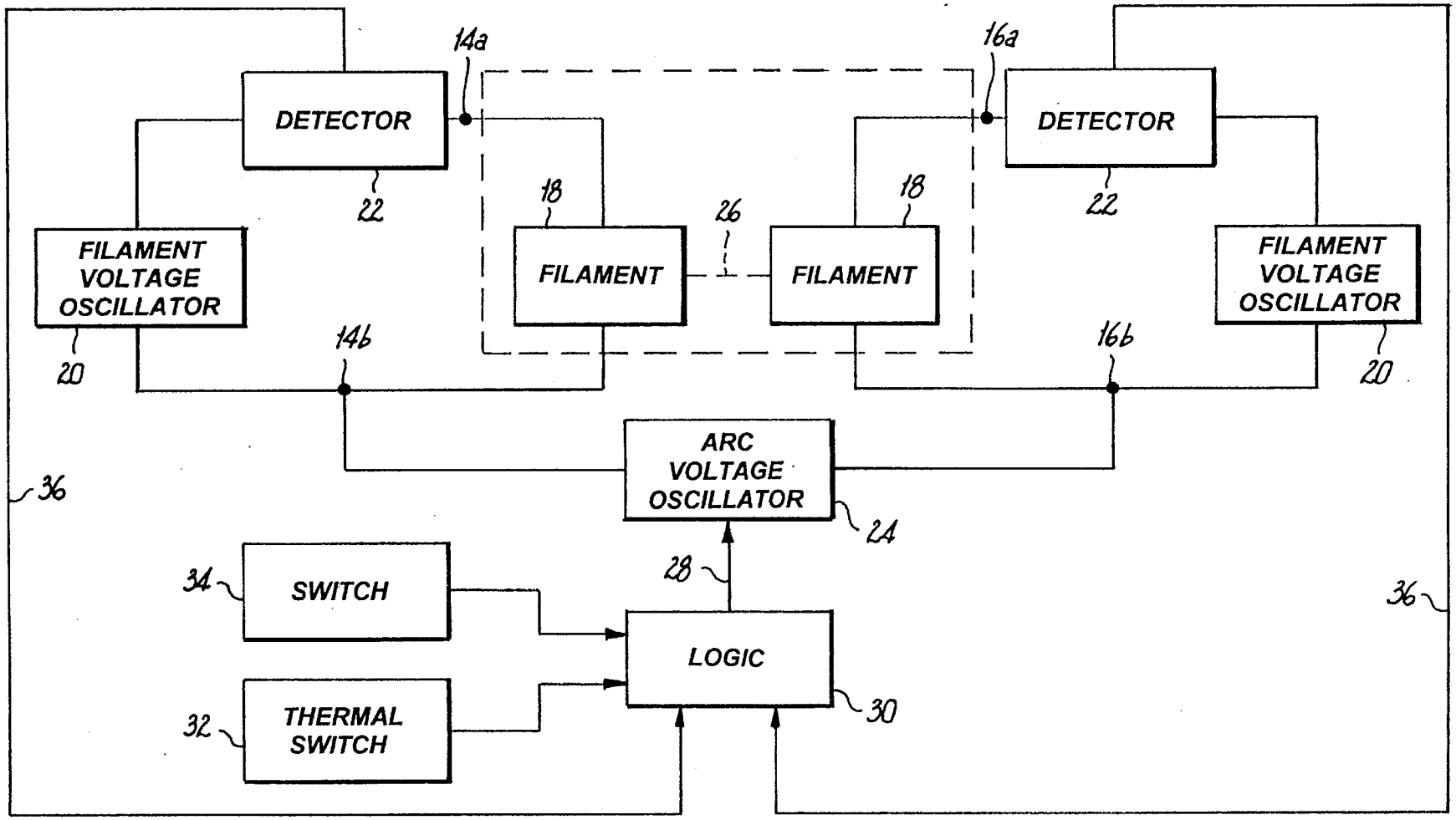
FIG. 1 shows a block diagram of the salient features of a circuit for a ballast arrangement of the present invention.
Figure 2A:
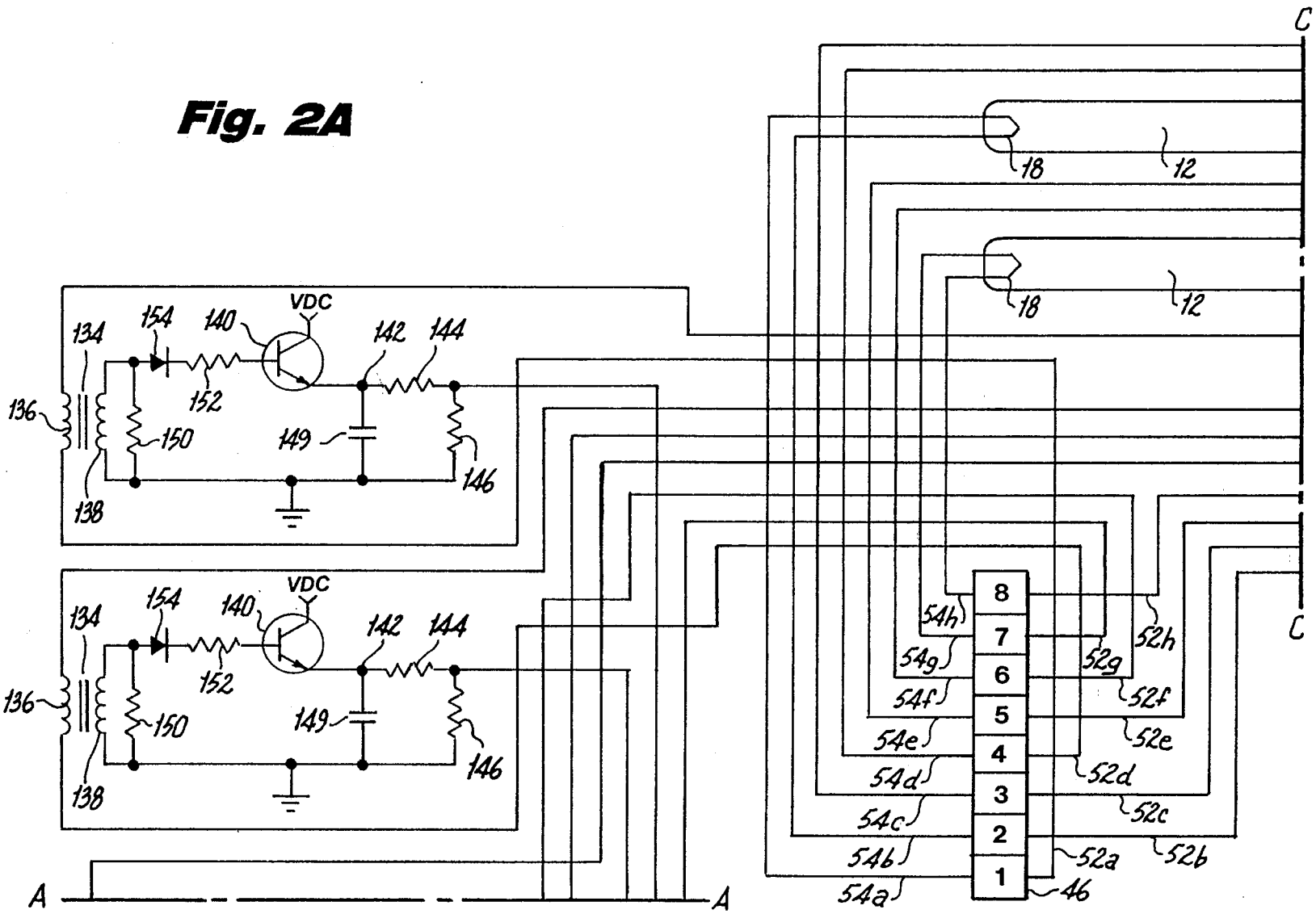
FIG. 2A shows the upper left side portion of a schematic circuit diagram of a preferred embodiment of a ballast arrangement according to the present invention adjoining FIG. 2B along match line A—A and FIG. 2C along match line C—C.
Figure 2B:
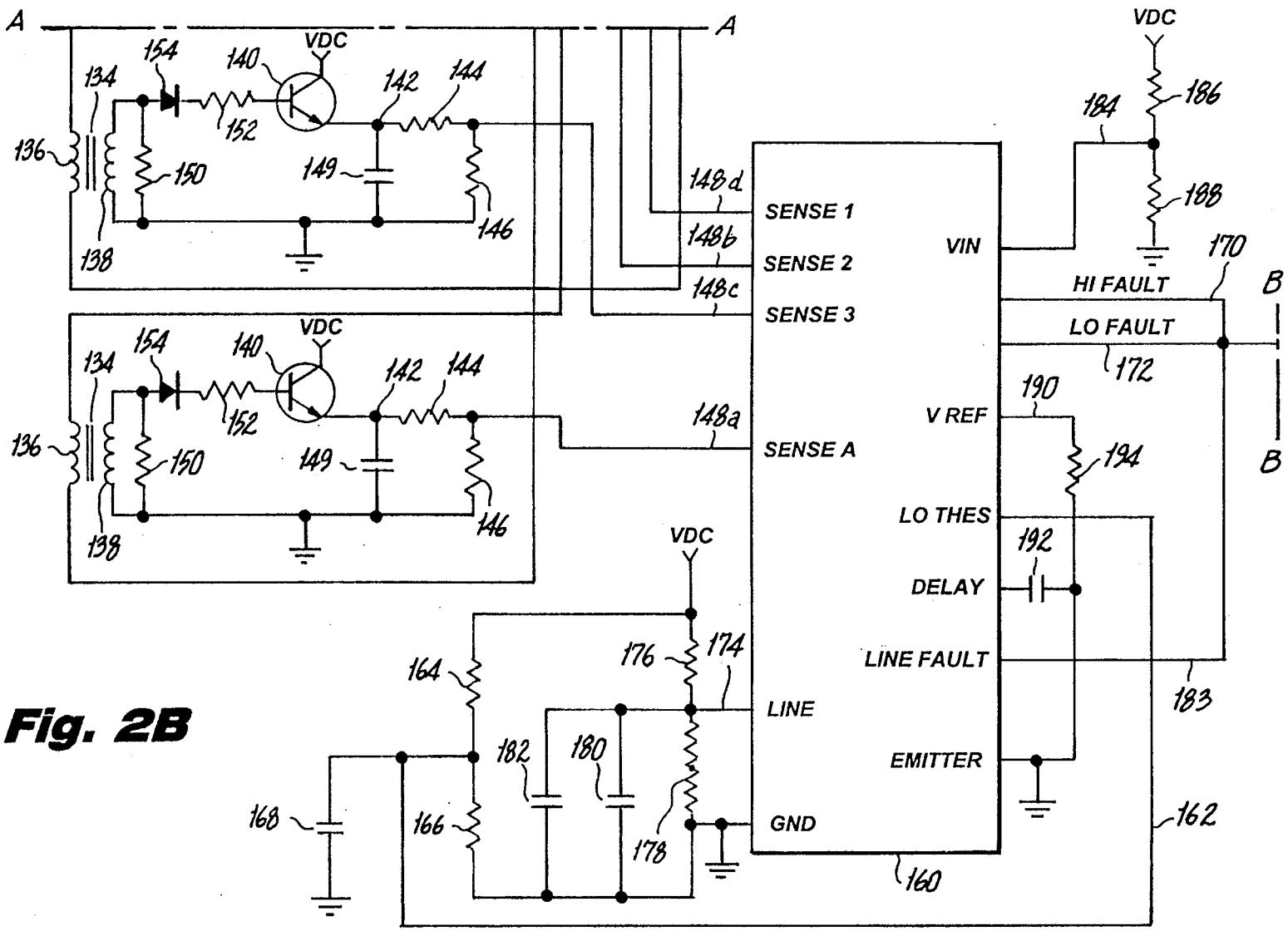
FIG. 2B shows the lower left side portion of the schematic circuit diagram adjoining FIG. 2A along match line A—A and adjoining FIG. 2C along match line B—B.
Figure 2C:
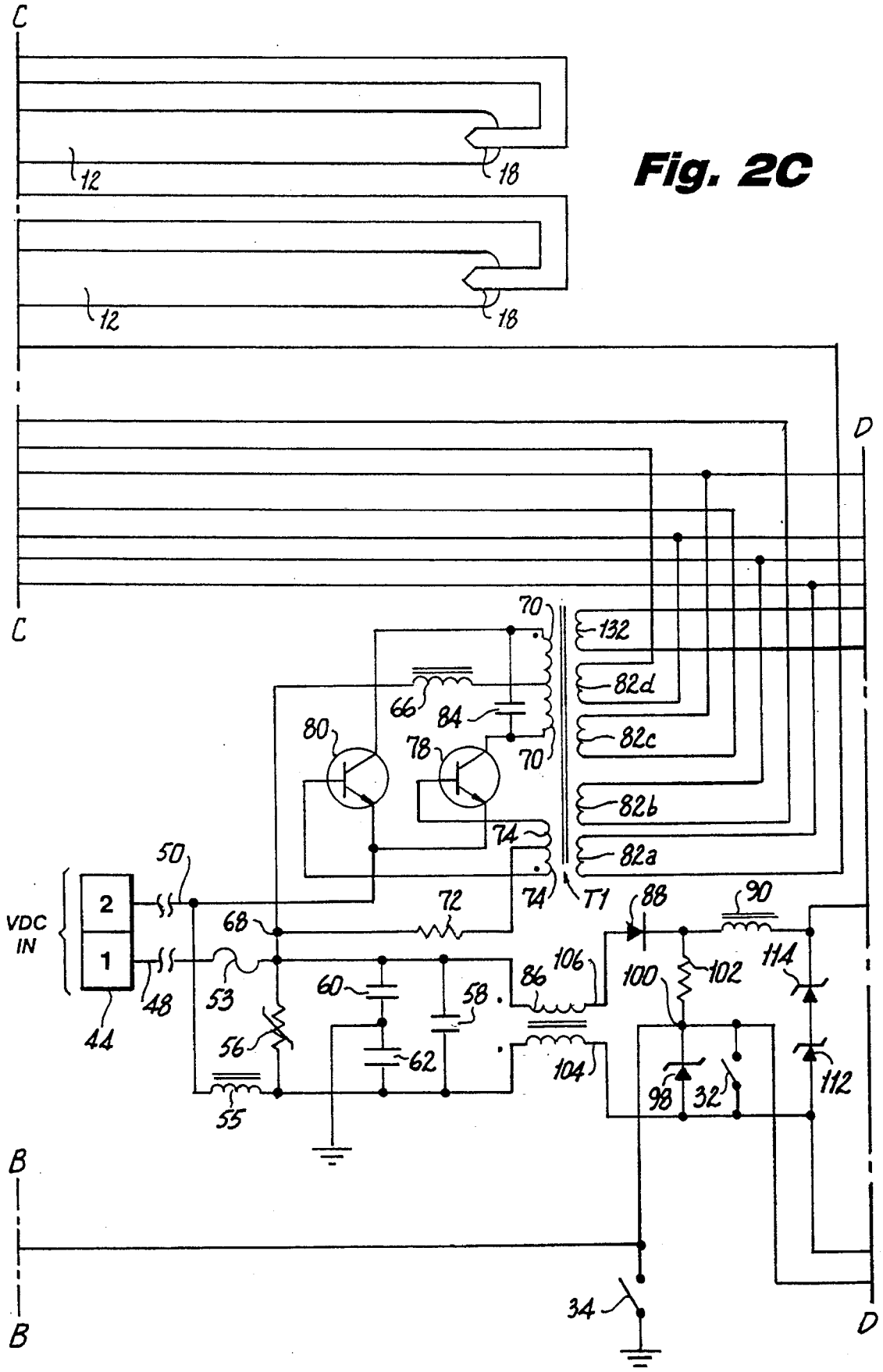
FIG. 2C shows the central portion of the schematic circuit diagram adjoining FIGS. 2A and 2B along match lines C–C and B–B, respectively and adjoining FIG. 2D along match line D–D.
Figure 2D:
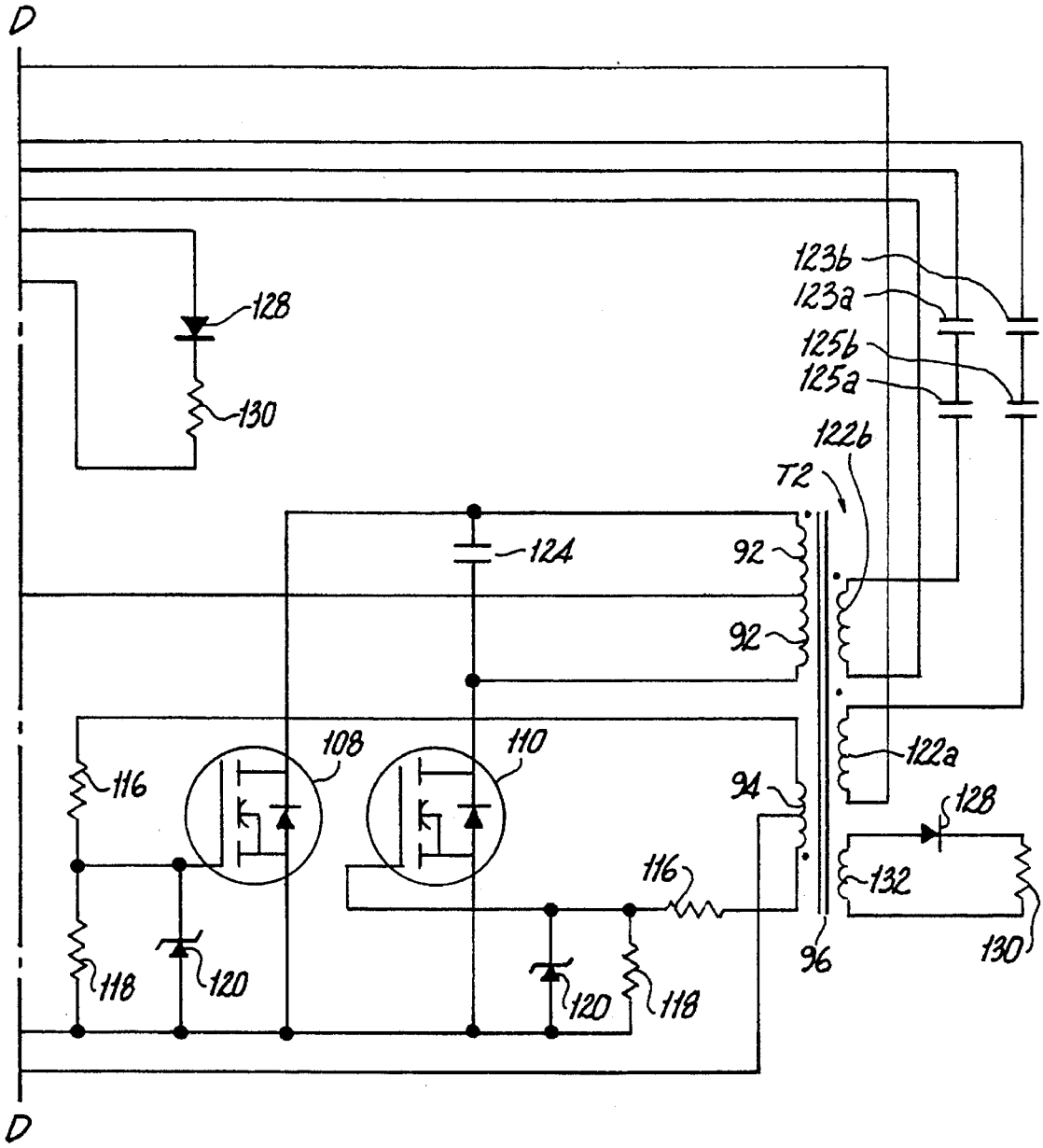
FIG. 2D shows the right side portion of the schematic circuit diagram adjoining FIG. 2C along match line D—D.

Referring to the drawings, FIG. 1 shows a block diagram of the salient features of a circuit containing the ballast arrangement 10 of the present invention. By way of overview and introduction, the ballast arrangement 10 is shown connected to a fluorescent lamp 12 having terminal pairs 14*a*, 14*b* and 16*a*, 16*b* (more generally referred to as terminals 14 and 16). The lamp 12 has filaments 18 at each end which are connected across the terminals 14 and 16 to voltage oscillator and detection circuits that comprise the inventive ballast arrangement. In particular, a filament voltage oscillator 20 is connected to each filament 18 so that a filament voltage appears across each of the terminal pairs 14, 16. Further, a detector circuit 22 is connected to each filament 18 so that the integrity of each filament 18 powered by the ballast arrangement 10 can be monitored, and so that safe operating conditions can be maintained regardless of the condition of the lamp 12. As used herein, "condition" refers to the present state of a lamp attached to the ballast arrangement 10. A high or arc voltage oscillator 24 is connected across the lamp 12 at one end to terminal 14 and at another end to terminal 16. In FIG. 1, the arc voltage oscillator ("AVO") 24 is illustrated as being connected across terminals 14*b*, 16*b*, although it may have one terminal connected to either of terminals 14*a*, 14*b* and the other terminal connected to either of terminals 16*a*, 16*b*. When a voltage sufficient to induce lamp arcing is applied by AVO 24, an arc discharge path 26 is formed in the lamp between the two filaments 18 to complete the arc voltage circuit.

Among many possible fault conditions are broken lamp filaments, overly-sputtered lamp filaments, improper seating of the end pins of the lamp in its socket (see U.S. Pat. No. 5,261,831 to Vendal et al.), and arcing at the lamp socket. The filament voltage oscillators ("FVO") 20 maintain the voltage at the filaments 18 during any interrupt or fault condition. Thus, the filaments remain warm and the subsequent application of the high voltage to cause the lamps to arc will result in a soft-start during which filament sputtering is significantly reduced or eliminated. According to an aspect of the invention, a control line 28 is provided to interrupt a power source that drives the AVO 24. The control line 28 is responsive to signals from, for example, a logic circuit 30 which may comprise a comparator circuit, a thermal cut-off switch 32, a manually (or automatically) activated switch 34, or a combination of them. In accordance with a feature of the invention, the logic circuit 30 provides a predetermined delay when the lamp circuit is first turned-on, for example, two seconds, after which the power is applied to the AVO 24. Meanwhile, the FVO 20 has been applied to the filaments 18 to pre-warm the filaments and enable the lamp to soft-start.

Further, the logic circuit 30 may be responsive to signals from the detector circuit 22, as by lines 36, so that power to the AVO 24 can be temporarily interrupted when any of the foregoing fault conditions is detected. The thermal cut-off switch 32 may interrupt power to the AVO 24 when the switch reaches a predetermined temperature, for example, 115° C.±5° C. The manual (or automatic) switch 34 may interrupt the power to the AVO 24 in response to any other condition, such as, for example, when the door of a bus is opened or in response to a separate control system.

FIG. 2 shows a schematic diagram of a preferred embodiment of a ballast arrangement according to the present invention, illustrated as applied to a two-lamp circuit, although the principle is usable with more than two lamps. The ballast arrangement is constructed within a housing 42 or is otherwise encapsulated, and is provided with an input connector 44 and an output connector 46. The input connector 44 has an input voltage lead 48 and a ground lead 50 extending from connector 44 for conveying a DC input voltage (not shown) such as a bus battery to the ballast arrangement. The output connector 46 has a plurality of leads 52A to 52H adapted to be coupled to respective output lines 54A to 54H to which the lamps 12 are connectable by mating sockets or as otherwise known in the art. The ballast arrangement may include a circuit board (not shown) on which the electronic components are mounted in conventional manner.

Located within the housing 42 are a series of electrical networks generally of the type described in connection with FIG. 1. More particularly, a 37.5 volt DC source (not shown) is adapted to be connected across the terminals of input connector 44 to provide DC to the ballast circuit. The low potential input lead 50 from the input connector 44 serves as a ground for the independent oscillators that comprise the inventive ballast arrangement, as described more fully below.

The input current in the ballast circuit passes through a fuse 53 which protects the ballast circuit from any current overloads or surges. The fuse may, for example, be a slow-blow type rated at 6.3 amps, 250 volts. A current-smoothing and voltage-limiting circuit operates on the input voltage to better ensure proper operation. In the illustrated embodiment, this circuit comprises an inductor 55 in series with the parallel combination of (1) a varistor 56, (2) a capacitor 58, and (3) series connected capacitors 60, 62 having a ground point 64 therebetween. Capacitor 58 may be of any value suitable for smoothing the current, for example, about 1.0 μF at 250 volts. Varistor 56 is preferably a fifty-six volt metal oxide varistor such the ZNR14K560 available from Panasonic and capacitors 60, 62 may be, for example, 0.1 μF.

The high voltage lead 48 provides a bias voltage to the filament and arc voltage oscillators. Because the filament voltage oscillator need only generate a voltage of approximately 3.6 volts root mean square ("rms"), it has a relatively simple construction as compared to the arc voltage oscillator. An inductor 66 is connected at a first end to the high potential side of the current-smoothing and voltage-limiting circuit at 68, and at a second end to a center tap of a winding 70 of transformer T2. Inductor 66 prevents current surges from reaching the winding 70 and likewise prevents voltage surges at the output of transformer T2. The drive voltage for the transistors 78, 80 in this filament voltage oscillator ("FVO") circuit (described below) is dropped to a suitable value across a resistor 72. Transformer T2 is used in the filament voltage oscillator circuit both as a voltage step-down device and as part of an oscillator described more fully below. In addition to the transformer winding 70, a drive winding 74 is formed on the same core 76 and is supplied at its center tap with a transistor drive voltage from the voltage smoothing circuit through the resistor 72.

The FVO circuit is driven by a pair of NPN bipolar junction transistors ("BJT") 78, 80 which invert and step-down the incoming DC current to approximately a 3.6 volt AC signal. Suitable BJTs include the BU406 available from Motorola. The collector of each BJT is directly connected to opposite ends of the winding 70. The emitter contact of each BJT is connected to ground lead 50. In such a configuration, there will be no conduction from emitter to collector until the base-emitter junction is forward biased.

The base of each BJT 78, 80 is directly connected to opposite ends of the drive winding 74. When a suitable current is applied to the base, a complete circuit is established from ground lead 50 through one of BJTs 78, 80 to one end of transformer winding 70 through one half of the winding to its center tap and through inductor 66 to high potential at 68. Because the base of each BJT is tied to a respective opposite end of the center tapped drive winding 74, the BJTs will be alternatively driven into conduction by the switching of currents in windings 70. Initially, one of BJTs 78, 80 will be electrically favored and then the transistors will conduct alternately thereby inducing an alternating current, preferably at approximately 20 kilohertz. When BJT 78 is conducting, a first end of transformer winding 70 will be tied to ground lead 50 through BJT 78 while a second end will not provide a complete circuit. This condition will persist until BJT 80 is driven into conduction at which time BJT 78 will turn off; the second end of transformer winding 70 will instead be tied to ground lead 50 through BJT 80.

Thus, in a secondary winding 82*a*, 82*b*, 82*c*, or 82*d* of transformer T2, there will be induced an alternating voltage having a voltage step-down in proportion to the turns ratio of the transformer. The voltage step-down provides approximately 3.6 volts AC to each filament 18. A capacitor 84 is connected across opposite ends of transformer winding 70 to smooth the inversion. Illustratively, capacitor 84 may have a capacitance of about 0.001 μF and a 1600 VDC rating so that the induced alternating current will approximate a sinusoid at the operating frequency.

The stepped-down voltage in the secondary windings 82*a*, 82*b*, 82*c*, and 82*d* is conveyed to the output connector 46 along leads 52*a* to 52*h*. More particularly, opposite ends of secondary winding 82*a* are connected to leads 52*a* and 52*b* of the output connector 46 to provide a first filament voltage on output lines 54*a* and 54*b*. Similarly, the ends of secondary winding 82*b* are connected to leads 52*c* and 52*d* of the output connector 46 to provide a second filament voltage on output lines 54*c* and 54*d*; the ends of secondary winding 82*c* are connected to leads 52*e* and 52*f* to provide a third filament voltage on output lines 54*e* and 54*f*; and the ends of secondary winding 82*d* are connected to leads 52*g* and 52*h* to provide a fourth filament voltage on output lines 54*g* and 54*h*. Each of the first, second, third, and fourth filament voltages is preferably at the same voltage level.

The arc voltage oscillator circuit AVO is shown also in FIG. 2. The AVO is coupled to the voltage smoothing circuitry by a common mode inductor 86 and blocking diode 88. These elements protect the ballast circuit from damage which could otherwise result if the module is subject to excessive or reverse voltage. Preferably, the blocking diode 88 is rated at 8 amperes or more at 600 V.

Transformer T1 is used in the AVO circuit both as a voltage step-up device and as part of an oscillator. The AVO provides approximately 527 volts to an open circuit and can provide 250 mA of current to drive one or more lamps 12. An inductor 90 is connected at a first end to the cathode of the blocking diode 88, and at a second end to a center tap of a winding 92 of the transformer T1 and functions similar to the inductor 66. In addition to the transformer winding 92, a drive winding 94 is formed on the same core 96. The center tap of this drive winding 94 is supplied with voltage at an oscillator-interrupt node 100 disposed between the cathode of a zener diode 98 and a resistor 102. The zener diode 98 and resistor 102 are connected in series across the input voltage terminals 104, 106 of the AVO circuit. Zener diode 98 regulates the transistor drive voltage at the center tap of drive winding 94, and is preferably of the type 1N5337B from, for example, Motorola, capable of regulating the voltage to 4.7 volts. Resistor 102 may be approximately 3.3 kilohms rated at 1 watt.

An AVO circuit driven by a pair of n-channel enhancement mode MOSFETs 108, 110 inverts the incoming DC to AC. The drain of each MOSFET is directly connected to a respective one of the opposite ends of the winding 92. A series connection of two zener diodes 112, 114, preferably of the type 1N6288A capable of limiting the voltage across MOSFETs 108, 110 to approximately fifty-one volts, is connected between the second end of inductor 90 and the ground lead 50. The MOSFETs may be, for example, the type IRF644 field effect transistors of the International Rectifier Corporation of California. The selected MOSFETS should have a current rating suitable for driving several fluorescent lamps 12 connected to the circuit at connector 46. The substrate of each MOSFET is tied to its source contact and the source contact is in turn connected to ground lead 50. In such a configuration, there will be no channel until the gate source voltage exceeds the threshold voltage of the device. When a voltage greater than either of the MOSFET 108's and 110's respective threshold voltages is applied to their respective gates, a channel will be formed in the device which causes it to conduct from source to drain.

The gate of each MOSFET 108, 110 is connected to opposite ends of the drive winding 94 by means of a voltage regulator circuit. The gate voltage of each MOSFET 108, 110 is regulated by the voltage regulator circuit which comprises a voltage divider network of resistors 116, 118 coupled with zener diode 120, preferably of the type 1N4746A capable of clamping the gate-source junction to no more than, illustratively, eighteen volts. Resistors 116 and 118 are illustratively twenty-nine ohms (1 watt) and 3.9 Kilohms (½ watt), respectively.

As in the FVO, a voltage is applied to the gate of MOSFET 108, for example, completes a circuit from ground lead 50 through that device to one end of transformer winding 92 through one half of the winding to its center tap and through inductor 90 to high potential. Because the gate of each MOSFET is tied to a respective opposite end of the center tapped drive winding 94, the MOSFETs will be alternatively driven into conduction by the switching of currents in windings 92 because the applied gate voltages will have opposite polarity. Initially, one of MOSFETs 108, 110 will be electrically favored and the transistors will conduct alternately thereby inducing an alternating current, preferably at approximately 45 kilohertz. When MOSFET 108 is conducting, a first end of transformer winding 92 will be tied to ground lead 50 through MOSFET 108 while a second end will not provide a complete circuit. This condition will persist until MOSFET 110 is driven into conduction at which time MOSFET 108 will turn off; the second end of transformer winding 92 will instead be tied to ground lead 50 through MOSFET 110.

Thus, in a secondary winding 122*a*, 122*b* of transformer T1, there will be induced an alternating voltage having a voltage step-up in proportion to the turns ratio of the transformer. The voltage step-up provides approximately 527 volts to an open circuit and 250 mA of current to drive one or more lamps 12, as previously noted. A capacitor 124 is connected across opposite ends of transformer winding 92 to smooth the inversion. Illustratively, capacitor 124 may have a capacitance of about 0.022 μF at 1000 VDC so that the induced alternating current will approximate a sinusoid at the operating frequency.

The stepped up voltage in the secondary windings 122*a* and 122*b* is conveyed to the output connector 46 along leads 52. The opposite ends of secondary winding 122*a* are connected to leads 52*e* and 52*g* to provide an arc voltage on output lines 54*e* and 54*g* and the opposite ends of secondary winding 122*b* are connected to leads 52*b* and 52*c* to provide an arc voltage on output lines 54*b* and 54*c*. In series with each of the secondary windings 122*a* and 122*b* along leads 52 are a pair of capacitors 123, 125, which preferably are 3300 μF at a 1600 volt rating. The capacitors 123, 125 impose a current limiting impedance in leads 52, and preferably permit sufficient current to flow to achieve full (or if desired reduced) brightness. This current may be approximately 250 mA or less. Because the capacitors 123, 125 share the voltage across each lamp 12, these elements may have a lower voltage tolerance which permits a cost savings in the construction of the ballast arrangement. The capacitors associated with secondary winding 122*a* may have different capacitance than those associated with secondary winding 122*b* to provide a light level determining circuit, as described more fully in U.S. Pat. No. 5,349,272, the entirety of which is incorporated by reference as if set forth herein. The current should properly operate a standard T8 lamp having a normal operating mode of 250 mA. Similarly, a pair of T12 lamps or a combination of a T8 and T12 lamps can be operated using this ballast arrangement, with appropriate component values.

Because transformer T1 may get sufficiently hot to damage its windings and because the ballast circuit may be used in cramped or hot environments, such as near a pipe or during the summer months, a fault or interrupt condition may heat the ballast circuit. Therefore, a thermal cut-off switch 32 is connected across the zener diode 98 as extra protection for the ballast circuit. On occurrence of excess temperature, the contacts of the normally-open thermal switch 32 will close thereby grounding the arc voltage oscillator until a more amiable temperature is realized. A suitable thermal cut-off switch is the MTS115A manufactured by Midwest Comp.

A power indicator circuit may also be coupled to each of cores 76, 96 to indicate whether the independent oscillators in the ballast circuit are operating normally. Preferably such a circuit would comprise a series connection of a light emitting diode 128 and a suitably chosen resistor 130 connected across a secondary winding 132. The diodes 128 for the independent oscillators may emit light in different portions of the visible spectrum to differentiate the two oscillators, for example, the diode 128 for the FVO may emit yellow light while the diode 128 for the AVO may emit green light.

The circuit described herein is adapted to provide an arc voltage to two lamps whenever a fault or interrupt condition does not subsist. With the foregoing in mind, fault or interrupt detector circuit 22 is now more fully described. As previously, noted, there is a detector circuit 22 associated with each lamp filament 18. Thus, for the ballast circuit shown, there are four discrete detector circuits 22 illustrated, although the invention is not so limited. Fewer detector circuits 22 can be used to monitor the current in the filaments 18 of one or more lamps, as understood by those skilled in the art. The detector circuits 22 are identical; accordingly, only one of the detector circuits 22 is described.

In principle, the detector circuit 22 provides a means for monitoring the condition of each of the lamp filaments 18 in real-time so that the arc voltage may be terminated in the event of a fault or interrupt condition. In combination with certain logic or switching elements, the detector circuit 22 conserves the power that would otherwise be expended in maintaining the arc voltage on a faulty or inoperative lamp, and maintains a safe operating environment for maintenance personnel, other persons, and property by reducing, if not eliminating, shock and fire hazards associated with the more than 500 volt output of the arc voltage source.

As shown in FIG. 2, each detector circuit 22 comprises a detection transformer 134 having a primary winding 136 in series with the lead 52, between the connector 46 and one end of the secondary windings 82. When there is current flow through the filament 18, there is also current flow through the primary winding 136. This induces a current in a secondary winding 138 of the detection transformer 134. The induced current causes a BJT 140 to conduct. The BJT 140 may be a high voltage, NPN transistor such as the Motorola BU406. The conducting BJT 140 causes current flow at node 142. The current causes a voltage drop across a voltage divider comprising resistors 144, 146 to provide a sense voltage on one of the output lines 148*a*, 148*b*, 148*c*, and 148*d* that is nominally 1.5 volts DC. Resistors 144 and 146 that comprise the voltage divider to the output lines 148 may be, for example, 1.2 and 2 Kilohm ¼ watt elements, respectively. A smoothing capacitor 149 buffers the conduction of the BJT 140, and is preferably 1 μF and rated to 50 Volts.

On the input side, the detector circuit 22 includes a current divider comprising resistors 150, 152 to divide the current that appears at the base of the BJT 140. Resistors 150 and 152 may be, for example, 100 ohm 1 watt and 10 ohm ¼ watt elements, respectively. Also, a blocking diode 154 protects the BJT 140 from damage which could otherwise result if the circuit is subjected to excessive currents. A suitable diode 154 is the 1N4448 from Diode Incorp. rated at 500 mW.

The detector circuit 22 is configured to nominally provide a 1.5 volt DC signal on output lines 148 during normal or safe lamp operating conditions. However, when a lamp filament breaks, no current will flow in lead 52 and therefore no current will be induced in the secondary winding 138 of the detection transformer 134. As a result, the BJT 140 will stop conducting and the voltage on output lines 148 will be approximately 0.2 V or lower. Further, enhanced current flow in lead 52 can lead to a higher output voltage on lines 148 during lamp arcing conditions. In particular, when the lamp 12 is improperly seated in its socket so that the lamp pins (attached to the filaments) do not make good contact with output lines 54 (that is, there is arcing between the pins and socket), as when the lamp 12 vibrates or bounces in its socket, or when the filament 18 is near the end of its life, a quasi-fault condition may occur with the result that a higher base current is applied to the BJT 140, enhancing its current conduction between collector and emitter, and causing a voltage of 2.2 volts or greater to appear on output lines 148.

In accordance with one aspect of the present ballast arrangement, the AVO 24 ceases to oscillate when a voltage appears on the output lines 148 of any of the detector circuits 22 which deviates from the nominal voltage of approximately 1.5 volts by more than a predetermined range, for example, ±0.6 volts. A voltage above or below the predetermined range causes all of the lamps 12 connected to that AVO 24 to cease producing flight until safe conditions are restored.

In a preferred embodiment and as illustrated in the schematic of FIG. 2, the logic circuit 30 which shuts down the AVO under such conditions may comprise a quad power fault monitor ("QPFM") 160 such as the SG1548 manufactured by Silicon General, Inc. of Garden Grove, Calif., which is described in the Silicon General Linear Integrated Circuits Data Sheet at pages 4–157 to 4–160 and in the Application Notes at 12–91 to 12–97, the entirety of which are incorporated by reference as if set forth herein. The QPFM 160 can monitor up to four positive DC voltages simultaneously for overvoltage and undervoltage fault conditions, and has other features that advantageously may be adapted in further aspects of the inventive ballast arrangement, as described below.

According to the preferred embodiment, the logic circuit 30 is implemented, in part, using the QPFM 160 to simultaneously monitor the voltages on output lines 148*a*, 148*b*, 148*c*, and 148*d* from the four detector circuits and compare the highest and lowest of these voltages to nominal overvoltage and undervoltage thresholds, respectively. These overvoltage and undervoltage thresholds are established with regard to a predetermined low-threshold voltage 162. The predetermined low-threshold voltage is established by dividing the DC input voltage that appears on lead 48 to a predetermined value, preferably 1.5 volts. Where the DC input voltage is 37.5 volts, this may be achieved by dividing the input voltage using the resistors 164, 166 which may be, for example, 4.7 MΩ and 240 KΩ ¼ watt resistors. A 1 μF capacitor 168 may be placed across resistor 166 to filter the low-threshold voltage. When the low-threshold voltage is set to 1.5 volts, the overvoltage and undervoltage thresholds are approximately 0.9 and 2.1 volts, respectively.

As previously noted, each of the output lines 148 provides the QPFM 160 with a nominal voltage of 1.5 VDC during normal or safe lamp operating conditions, and a voltage that is either lower than 0.9 volts or higher than 2.1 volts during fault or interrupt conditions. When the highest voltage signal on any line 148 exceeds the overvoltage threshold, a signal on high-fault line 170 is pulled to a low logic level or ground potential. Because high-fault line 170 is connected to the node 100, the detection of a high-fault condition causes the logic circuit 30 to short the terminals of the zener diode 98 and thereby ground the drive winding 94 of the AVO 24. As a result, the AVO 24 ceases to oscillate and the lamp(s) 12 connected to the ballast circuit cease producing light, while the lamp filaments 18 remain warm due to the FVO 20 which is unaffected by the detection of the high fault condition. Likewise, when the lowest voltage signal on lines 148 drops below the undervoltage threshold, a signal on low-fault line 172 is pulled to a low logic level or ground potential. Low-fault line 172 is also connected to the node 100, and therefore the detection of a low-fault condition causes the AVO 24, but not the FVO 20, to terminate oscillating. Apart from these fault conditions, the signals on lines 170 and 172 are nominally at a logic high level.

In accordance with another aspect of the present ballast arrangement, the logic circuit 30 temporarily grounds the drive winding 94 of the AVO 24 while the FVO 20 warms the filaments 18 during a cold start of the ballast circuit. The QPFM 160 can advantageously be used to implement this "soft-start" feature which reduces sputtering of the filaments 18, and also permits a lamp arc current 26 to initiate at a lower excitation voltage.

The QPFM generates a 2.5 volt reference voltage which is compared to a voltage on a line sense input 174 to determine, according to the invention, whether a cold start has occurred. The voltage on line sense input 174 is nominally set to 2.5 volts by dividing the DC input voltage that appears on lead 48. For example, if the DC input voltage is 37.5 volts, then a 2.5 volt line sense input 174 is achieved by dividing the input voltage using the resistors 176, 178 which may be, for example, 4.7 MΩ and 240 KΩ ¼ watt resistors. To achieve the aforementioned soft-start, a pair of 1 μF 50 volt capacitors 180, 182 are placed across resistor 178 to gradually ramp the DC input voltage on line 174 by charging the capacitors 180, 182 to the 2.5 volt reference level. Preferably, the time period for ramping the voltage on line 174 is two seconds. Until the 2.5 volt reference level and the voltage on line 174 compare favorably, a signal on a soft-start line 183 is maintained at a low logic level or ground potential. Thereafter, the soft-start line 183 returns to its normal high logic level. Soft-start line 183 is connected to the node 100 of the AVO 24. Thus, while the voltage on line 174 ramps to the 2.5 volt reference level, the FVO 20 provides a filament voltage to warm the lamp filaments 18. As a result, a soft-start of the lamp occurs after the delay period when the AVO 24 begins to oscillate and applies an arc voltage to the prewarmed filaments 18. Other capacitive, inductive, or active circuit arrangements could be used to achieve the desired ramping of the voltage on line 174.

The 2.5 volt reference voltage is generated by the QPFM 160 when energized with an input voltage on a line 184. The supply voltage may be the DC input voltage that appears on lead 48, or, as shown in FIG. 2, may be scaled to a lower voltage by a voltage divider network comprising resistors 186 and 188 to ensure that the supply voltage is within the prescribed limits of the QPFM 160 chip. Further, the 2.5 volt reference voltage is provided on a line 190 which may advantageously be used for charging a fault-delay capacitor 192. The fault-delay capacitor 192 prevents the logic circuit 30 from responding to under- or overvoltage conditions that do not persist beyond a pre-set time interval. A resistor 194 drops the 2.5 volt reference voltage to a capacitor charging voltage. The resistor 194 may be 3.6 KΩ with a ¼ watt rating.

According to a further aspect of the present ballast arrangement, the AVO 24 ceases to oscillate by the logic circuitry 30 when the operating temperature exceeds a predetermined level, for example, 115° C.±5° C. The thermal cut-off switch 32 is connected between ground and the node 100, namely, across the terminals of the zener diode 98. The thermal cut-off switch 32 is normally open; however, on occurrence of excess temperature, the contacts close and thereby ground the drive winding 94 of the AV0 24. As previously described, this results in the AVO 24 ceasing to oscillate and the lamp(s) 12 connected to the ballast circuit to cease producing light, while the lamp filaments 18 remain warmby application of the filament voltage by the FVO 20. When safe operating temperatures are again realized, the thermal cut-off switch 32 opens. This permits the zener diode 98 to apply a voltage to the drive winding 94 of the AVO 24 and causes the AVO 24 to provide a voltage to the lamp(s) 12 sufficient to induce lamp arcing.

According to yet a further aspect of the present ballast arrangement, the AVO ceases to oscillate when a manual or automatic switch shorts the anode and cathode terminals of the zener diode 98, for example, by a switch configured to respond to a change of condition or environment other than as previously described, such as a conventional light switch.

The logic circuit 30 is configured so that any one of the aforementioned undervoltage, overvoltage, cold start, and thermal cut-off conditions, or the closing of a manual or automatic switch, causes the voltage at node 100 to drop to approximately ground potential and thereby reduce or eliminate the drive signal to the MOSFETs of the AVO 24. These signals, when high, permit the AVO 24 to generate an arc voltage and cause the lamp 12 to produce light. These signals are wired in a logical "or" configuration so that if any one of the signals goes low, the control line 28 (FIG. 1) or node 100 (FIG. 2) will be maintained in a low state. For example, if any one of the high-fault line 170, low-fault line 172, soft-start line 183, or switch configurations individually causes the voltage at node 100 to drop to approximately ground potential, then the other line signals will sink to a low potential, if not already at a low potential. As a result, each of the lamps 12 connected to that AVO 24 ceases producing light until the fault or interrupt condition is cured. When the fault or interrupt condition is resolved, as by replacement of the lamp 12, or by properly seating the lamp 12 in its socket, the AVO 24 automatically starts oscillating once the fault condition is no longer detected, which occurs moments after correction of the fault or interrupt condition.

In summary, the present ballast arrangement provides separate filament and arc voltage oscillators 20, 24 and a logic circuit 30 configured to terminate production of the lamp arc voltage independent of the filament voltage so that the lamp filaments 18 remain warm until a detected fault or interrupt condition is resolved. According to the schematic circuit diagram of the foregoing preferred embodiment, the lamp arc discharge is terminated by grounding the voltage at the center tap of the drive winding 94 of the AVO 24; however, the invention is not so limited. Rather than grounding the drive winding 94, for example, by dropping the voltage at the node 100 to approximately ground potential, or by shorting the terminals of the zener diode 98, the drive signal for the MOSFETs 108, 110 of the AVO 24 can be reduced (or eliminated) so that the voltage applied to the MOSFETs 108, 110 provides a voltage to the lamp(s) 12 that is insufficient to induce the lamp arc discharge. Hence, the detection of a fault or interrupt condition need not terminate all oscillation in the AVO 24; all that is required is that the AVO 24 provides a reduced voltage to the lamps 12 so that shock and fire hazards are reduced until the fault or interrupt condition is resolved.

While the logic circuit 30 has been described with reference to a particular integrated circuit, the invention is not so limited; the function of the logic circuit 30 can be readily implemented with discrete components. Further, the various circuit components are available as off-the-shelf components from numerous vendors, the particular selection of values and tolerances not being critical to the invention.

While the ballast arrangement 10 has been described for use with fluorescent lamps, which is the most preferred application, it may be useful in other applications requiring selective superimposition of a high voltage source over a continuous low voltage source, for example, with gas discharge lamps which radiate outside the visible spectrum.

From the foregoing description it will be clear that the present invention may be embodied in other specific forms without departing from the spirit or essential characteristics thereof. The presently disclosed embodiment and modification thereto is therefore to be considered as illustrative and not restricted, the scope of the invention being indicated by the appended claims.

What is claimed is:

1. A ballast circuit arrangement adapted to be connected to at least one fluorescent lamp, each lamp having two ends and a filament at each end, each filament having two terminals, said circuit arrangement comprising:

a filament voltage oscillator connectable across the two filament terminals at each lamp end for providing a filament current through the filaments of the at least one fluorescent lamp;

a separate arc voltage oscillator connectable to each of said fluorescent lamps between a first filament terminal at one of its two lamp ends and another filament terminal at the other of its two lamp ends for providing an arc voltage across each connected lamp, said arc voltage having either a first voltage value that is sufficient to induce an are discharge in each connected lamp, or a second voltage value that is insufficient to induce or maintain an arc discharge in each connected lamp;

control means for causing said arc voltage oscillator to have either of the first and second voltage values; and a detector circuit connected to each lamp filament for providing signals to said control means that change in response to a change in the filament current of any one of said filaments to which the detector is connected, said control means being responsive to said signals from said detector circuit to cause said arc voltage oscillator to not have the first voltage value until after said detector circuit has detected the filament current.

2. The ballast arrangement as in claim 1, wherein the second voltage value is zero volts.

3. The ballast arrangement as in claim 1, wherein the second voltage value provides less than 527 volts to an open circuit.

4. The ballast arrangement as in claim 1, wherein said control means is a switch.

5. The ballast arrangement as in claim 4, wherein said switch is a manually actuated switch.

6. The ballast arrangement as in claim 4, wherein said switch is actuated in response to changes in temperature.

7. The ballast arrangement as in claim 4, in combination with a control system that generates signals, wherein said switch is actuated in response to said signals from said control system.

8. The ballast arrangement as in claim 1, wherein at least one of the arc voltage oscillator and the filament voltage ocsillator is free-running.

9. The ballast arrangement as in claim 1, wherein said control means is a logic circuit responsive to the signals from said detector circuit for providing one of the first and second voltage values.

10. A ballast arrangement as in claim 1, wherein said detector circuit provides to said control means one of a first signal indicative of a normal operating condition and a second signal indicative of a fault or interrupt condition.

11. The ballast arrangement as in claim 10, wherein the first signal is nominally 1.5 volts.

12. The ballast arrangement as in claim 10, wherein the second signal is either greater or less than the first signal by at least a predetermined amount.

13. The ballast arrangement as in claim 12, wherein the predetermined amount is of the order of 0.6 volts.

14. A ballast arrangement as in claim 10, wherein said signals from said detector circuit are indicative of a broken lamp filament.

15. A ballast arrangement as in claim 10, wherein said signals from said detector circuit are indicative of a lamp filament near to the end of its usable life.

16. A ballast arrangement as in claim 10, wherein said signals from said detector circuit are indicative of an improperly seated lamp.

17. A ballast arrangement as in claim 10, wherein said signals from said detector circuit are indicative of arcing in the lamp socket.

18. A ballast arrangement as in claim 10, wherein said signals from said detector circuit are indicative of a lamp removed from its socket.

19. A ballast arrangement as in claim 1 for connection to a power source, wherein the arc voltage oscillator comprises:

a transformer including first and second primary windings each having a center tap, the center taps being adapted to be connected to one terminal of the power source;

a pair of MOSFET transistors, the transistors having their sources adapted to be commonly connected to another terminal of the power source, their gates being connected to opposite ends of the first primary winding, and their drains being connected to opposite ends of the second primary winding.

20. A ballast arrangement as in claim 19, wherein the control means comprises means adapted to connect the center tap of the first primary winding to the other terminal of the power source.

21. A ballast arrangement as in claim 1, for connection to a power source, wherein the filament voltage oscillator comprises:

a transformer including first and second primary windings each having a center tap, the center taps being adapted to be connected to one terminal of the power source;

a pair of bipolar transistors, the transistors having their emitters adapted to be commonly connected to another terminal of the power source, their bases being connected to opposite ends of the first primary winding, and their collectors being connected to opposite ends of the second primary winding.

22. The ballast arrangement as in claim 1, further comprising a soft start circuit for providing the filament voltage to the filaments for a predetermined time period before providing the arc voltage of said first voltage value to the connected lamp.

23. The ballast arrangement as in claim 22, wherein the predetermined time period is a time sufficient to warm the lamp filaments.

24. The ballast arrangement as in claim 22, wherein the arc voltage of said second voltage value is provided to the connected lamp during the predetermined time period.

25. The ballast arrangement as in claim 22, wherein the soft start circuit includes a capacitor having a charging time, and wherein the predetermined time period is the charging time of the capacitor.

* * * * *